United States Patent [19]

Beugin

[11] 4,006,928

[45] Feb. 8, 1977

[54] LAWN BAG CADDY

[76] Inventor: Louis E. Beugin, 2910 S. Hawthorne, Independence, Mo. 64052

[22] Filed: Dec. 10, 1975

[21] Appl. No.: 639,234

[52] U.S. Cl. ..... 294/1 R; 15/257.1; 150/49; 248/99

[51] Int. Cl.[2] ..... B65B 67/12; B65F 1/04

[58] Field of Search ..... 294/1 R, 19 R, 55; 15/104.8, 257.1, 257.2, 257.4, 257.7, 257.8; 56/400.11, 400.13; 150/1.8, 2, 5, 49; 248/95, 97, 99–101, 149–151, 153

[56] References Cited

UNITED STATES PATENTS

| | | | |
|---|---|---|---|
| 199,507 | 1/1878 | Brubaker | 248/100 |
| 2,621,497 | 12/1952 | Davie | 150/49 X |
| 3,312,263 | 4/1967 | Wahlstrom | 150/2 |
| 3,711,141 | 1/1973 | Soergel | 294/55 |
| 3,733,099 | 5/1973 | Szita | 294/55 |
| 3,744,081 | 7/1973 | Miller | 15/257.1 |
| 3,747,653 | 7/1973 | Ringer | 15/257.1 X |
| 3,934,803 | 1/1976 | Paulus | 248/99 |

*Primary Examiner*—Johnny D. Cherry
*Attorney, Agent, or Firm*—John A. Hamilton

[57] ABSTRACT

A lawn bag caddy consisting of an open wire frame adapted to be inserted snugly into the mouth of a lawn bag to hold the mouth open, the frame being adjustable in circumference to accomodate bags having different circumferences, and a stand operable to support the frame in a generally vertical plane when rested on the ground, the stand and frame being foldable to a substantially flat configuration for convenience of storage.

6 Claims, 7 Drawing Figures

LAWN BAG CADDY

Figure 1:
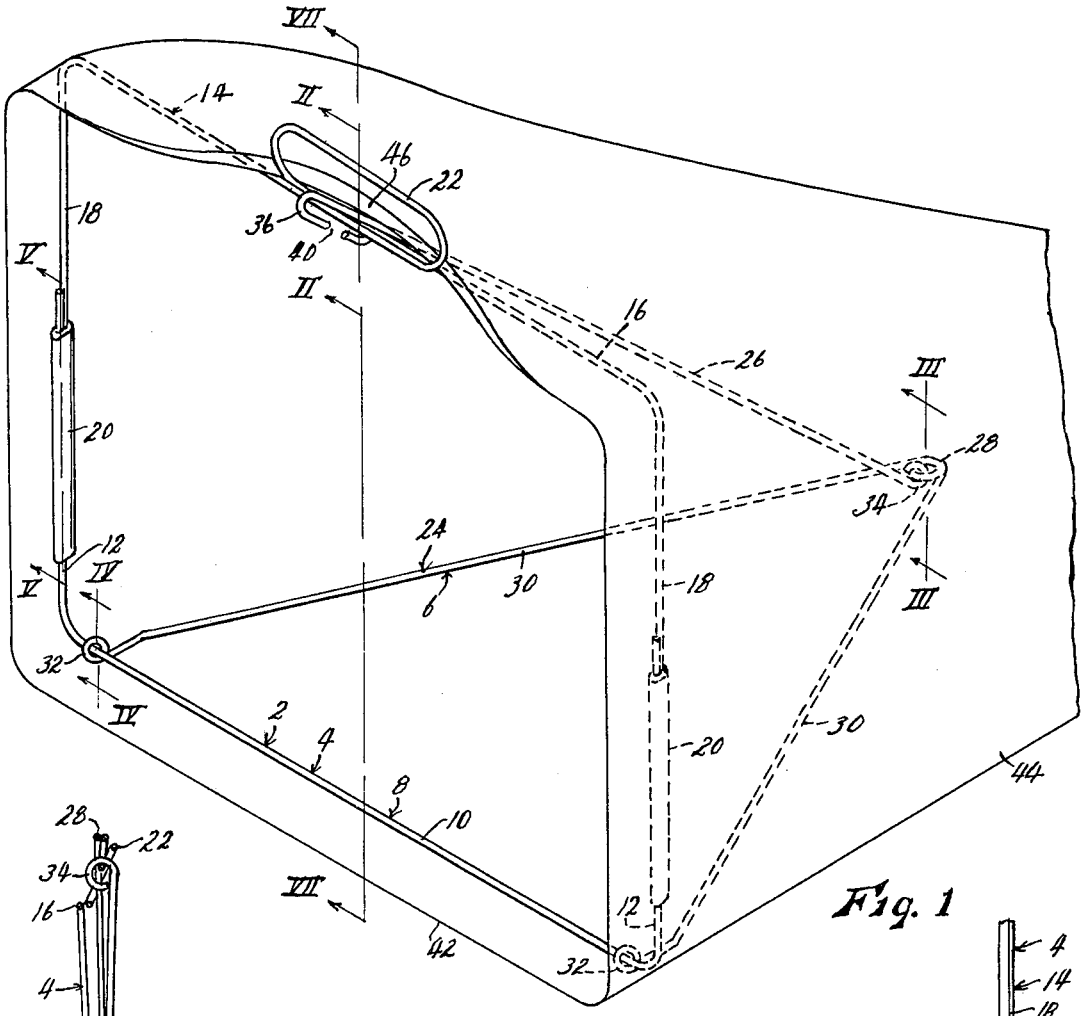

This invention relates to a device to be inserted into the mouth of a common lawn bag to hold the mouth of said bag in a wide open position for convenience in sweeping, raking or otherwise depositing leaves, twigs and other refuse therein. For lack of a more appropriate generic designation, it has been designated a lawn bag "caddy".

In recent years, during which the burning of leaves and trash has been largely prohibited, at least in metropolitan areas, for environmental reasons, the use of large bags, formed usually of a pliable plastic film, has become general and wide-spread for the collection and storage of leaves, twigs and other lawn trash, as well as other general refuse such as garbage, tin cans and the like, for later disposal by acceptable means.

However, as virtually everyone knows who has used such bags, it is often a difficult, exasperating and frustrating job to hold the bag mouth open while inserting the leaves and other trash therein, particularly during the early stages of filling, before the bag becomes formed and shaped to some extent by its contents. These difficulties arise primarily from the extremely limp and pliable nature of the plastic film of which these common bags are formed, although they are also apparent when hand filling a bag formed of paper, cloth or other pliable materials, and are particularly troublesome when the user must hold the bag in one hand only, using the other hand to manipulate a rake, broom or the like to impel the leaves or the like from a ground or other surface into the bag. The principal object of this invention is the provision of a device which functions to hold the bag mouth wide open in a simple, effective manner to render the insertion of the leaves, etc. into the bag an easy, convenient operation. To this end, the present device includes an open wire frame adapted to be inserted snugly into the bag, closely adjacent its mouth, to hold said bag mouth wide open.

Of course, the frame circumference must correspond closely to the bag circumference if the frame is to engage properly in the bag, and bags having several different sizes, and with different circumferences, are in common use. Accordingly, another object of the present invention is the provision of a bag caddy as described wherein the open frame is readily adjustable in circumference over a substantial range, whereby to accommodate it to bags of different sizes.

A further object is the provision of a lawn bag caddy of the character described additionally including a stand for said open frame, said stand being operable, when rested on the ground or other generally level surface, to support said frame in a generally vertical plane with its lower edge, and hence the lower edge of the bag mouth, directly at ground level. This facilitates the raking or sweeping of leaves or the like from said level surface directly into the bag.

A still further object is the provision of a lawn bag caddy of the character described in which the open frame and the stand may be folded into a flat, compact package, for ease and convenience of storage.

Other objects are simplicity and economy of construction, efficiency and dependability of operation, and adaptability for use in a wide variety of bagging operations.

Figure 2:
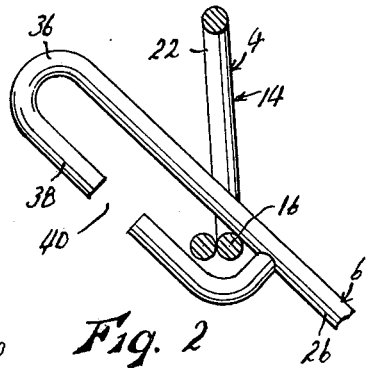
Figure 4:
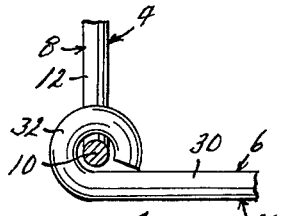
Figure 5:
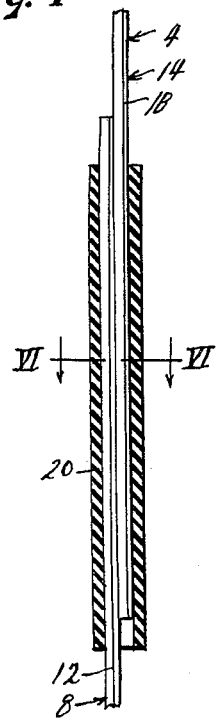
Figure 3:
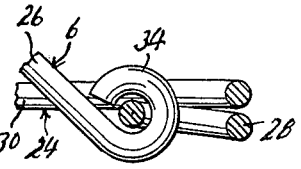
Figure 6:
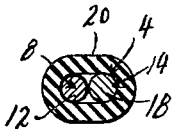
Figure 7:
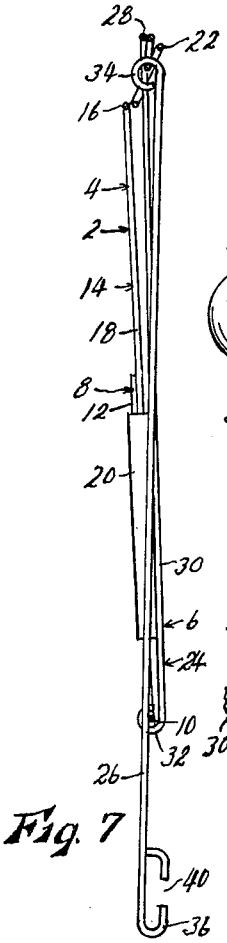

With these objects in view, as well as other objects which will appear in the course of the specification, reference will be had to the accompanying drawing, wherein:

FIG. 1 is a perspective view of a lawn bag caddy embodying the present invention, shown in operative relationship to a lawn bag, said bag being shown fragmentarily, FIG. 2 is an enlarged, fragmentary sectional view taken on line II—II of FIG. 1, with the bag omitted, FIG. 3 is an enlarged, fragmentary sectional view taken on line III—III of FIG. 1, with the bag omitted, FIG. 4 is an enlarged, fragmentary sectional view taken on line IV—IV of FIG. 1, FIG. 5 is an enlarged, fragmentary sectional view taken on line V—V of FIG. 1, FIG. 6 is an enlarged sectional view taken on line VI—VI of FIG. 5, and FIG. 7 is a sectional view taken on line VII—VII of FIG. 1, with the bag omitted, and with the caddy folded into a flat package for storage.

Like reference numerals apply to similar parts throughout the several views, and the numeral 2 applies generally to a lawn bag caddy embodying the present invention, best shown in its entirety in FIG. 1. It consists generally of an open wire frame 4 and a stand 6. As shown, frame 4 is of open, generally rectangular form and is formed of two U-shaped sections, the lower section 8 having a horizontal lower leg 10 and upright parallel legs 12 disposed respectively at the opposite ends of leg 10, and the upper section 14 having a horizontal top leg 16 parallel to leg 10 of the lower section, and depending parallel legs 18 disposed respectively at opposite ends of leg 16. Each of legs 18 overlaps the corresponding leg 12 of the lower frame section, and the two legs are enclosed in a resilient sleeve 20 consisting of a length of tubular hose formed of rubber or the like, which is sufficiently tight and supplies sufficient friction to prevent relative longitudinal shifting of the enclosed frame legs under stresses applied thereto in normal usage, but which will permit such relative longitudinal slippage of said legs when a still greater force is applied manually thereto. The frame is formed of heavy steel wire having sufficient strength to maintain the form of said frame under ordinary stresses of usage, but also possessing a substantial degree of resilience. Midway of its length, top leg 16 of the upper frame section is looped upwardly in a complete 360 degree bend to form a handle loop 22.

Stand 6 consists of a base 24 and strut 26. Base 24 comprises a length of wire bent in substantially V-form, looped to form an eye 28 at its apex, and with the free end of each of its legs 30 looped to form an eye 32 engaged pivotally about lower leg 10 of lower frame section 8, respectively adjacent the upright legs 12 of said frame section. Strut 26 comprises a length of wire looped at one end to form an eye 34 pivotally engaged in eye 28 of the base, and being formed at its opposite end to present a longitudinally elongated loop 36 (best shown in FIG. 2). Said loop opens transversely of the strut, and is closed at both of its longitudinal ends, but midway between its ends, the lower reach 38 thereof is interrupted to leave a transverse opening 40 into said loop.

In use, base 24 is pivoted to lie in a plane generally normal to the plane of frame 4, and the end of strut 26 carrying loop 36 is inserted through handle loop 22 of the top frame section, as indicated in FIG. 1. The double reach of top leg 16 of the upper frame section, which is at the bottom of the handle loop, is then inserted upwardly into loop 36 of the strut through opening 40, as best indicated in FIG. 2. The length of the strut is such that when stand base 24 is rested flat on the ground as in FIG. 1, top leg 16 of the frame will commonly be retained in the inner end of loop 36, as shown in FIG. 2. When the caddy is picked up by handle 22, leg 16 will slide to and be retained in the outer end of loop 36. Accidental disengagement is thus rendered unlikely.

The caddy is then inserted into the mouth 42 of a lawn bag 44, as shown, with frame 4 positioned just inside and parallel to the plane of the bag mouth, and with stand 6 disposed inwardly of the frame, within the bag. The circumference of the frame should of course correspond closely to the circumference of the bag wall, as to engage snugly in the bag to hold the bag and caddy in proper relation. Actually, if the bag is formed of the usual plastic film, it is preferable that the frame have a circumference at least slightly greater than the normal bag circumference, so that the bag must be elastically stretched to some degree to engage around the frame. The plastic film has sufficient elasticity to permit this stretching, and it provides a more secure mounting of the bag on the frame. The frame may of course be adjusted to the proper circumference for any particular bag by sliding frame legs 12 and 18 relative to each other within elastic sleeves 20. This adjustment requires the application of manual force greater than any force normally applied to said legs by the bag itself, so that the adjustment, once made, will be retained. The portion 46 of the wall of the bag (see FIG. 1) extended along the handle portion of top frame leg 16, and which normally would extend outwardly from the frame, is pulled back and engaged behind the handle, at the side of the handle opposite from the bag mouth, as shown in FIG. 1. This of course exposes the handle for easy grasping by the operator, and also provides, particularly if the bag has been elastically stretched, that the bag itself exerts a downward force on strut 26 tending to hold strut loop 36 against accidental disengagement from top frame leg 16. In this respect, handle loop 22 functions not as a handle, but simply as an outward projection of the frame behind which the portion of the bag wall which would otherwise project beyond the frame may be gathered to exert a downward force on the strut.

Thus it will be seen that a lawn bag caddy possessing several advantages has been produced. When inserted in a bag and base 24 of the stand is rested on the ground as in FIG. 1, it supports frame 4 in at least an approximately vertical plane and holds the bag mouth fully open, with its lower edge at ground level, so that leaves or the like may be raked or swept into the bag very easily and efficiently. Stand base 24 and strut 26 also hold the bag open for a substantial distance inwardly of the frame, and this further facilitates the entry of the leaves or other trash. Strut 26 offers only a minimal, insignificant obstruction to the passage of trash thereby. Of course, adjustment of the frame circumference as permitted by sleeves 20 will cause variable tilting of frame 4 from vertical, but within reasonable limits this variation will not adversely affect the positioning of the bag mouth as far as the insertion of trash is concerned. The stand also acts as a brace stabilizing the frame against tilting under forces exerted thereon when trash is inserted into the bag therethrough. The weight of the stand also counterweights the frame against overturning in a direction outwardly of the bag mouth. The caddy and attached bag may be carried from place to place as desired by grasping handle 22, without disturbing the horizontal opening of the bag. This may be desirable, for example, in advancing the bag over the ground to position it as desired relative to different piles of leaves or trash, or different portions of the same pile. The bag may also be carried in an upright position, since frame 4 may easily be grasped through the bag walls. The caddy also may be folded and secured in a substantially flat package for convenience of storage when not in use, as shown in FIG. 7. This may be accomplished by first disengaging strut loop 36 from top frame leg 16 and inserting said strut through the frame opening, then folding base 24 upwardly against the frame, and finally engaging handle loop 22 over eye portion 28 of the base. The parts are amply resilient to permit the slight flexure of the parts necessary to the accomplishment of this engagement. If necessary, to bring loop 22 into proper relation to base eye 28 for this purpose, the length of the side frame legs may be adjusted, as permitted by sleeves 20.

While I have shown and described a specific embodiment of my invention, it will be readily apparent that many minor changes of structure and operation could be made without departing from the spirit of the invention.

What I claim as new and desire to protect by Letters Patent is:

1. A lawn bag caddy comprising:

a. an open, generally rectangular frame adapted to be inserted snugly into the mouth of a lawn bag, adjacent and with its plane generally parallel to the plane of the bag mouth opening, said frame when disposed in a vertical plane having generally parallel upper and lower legs and generally parallel side legs, and b. supporting means connected to said frame and operable, when supported on the ground, to support said frame in an approximately vertical plane with its lower leg at ground level, said supporting means constituting a stand comprising a generally planar base member secured at one edge to lower leg of said frame and extending from said frame at approximately right angles to the plane thereof, and a diagonal strut secured at one end to the extended end of said base member and at its opposite end to the upper leg of said frame.

2. A lawn bag caddy as recited in claim 1 wherein said base member is pivoted to said frame on an axis coinciding with the lower leg of said frame, and wherein said strut is pivoted to said base member on an axis parallel to the pivotal axis of said base member, and is detachably connected to the upper leg of said frame, whereby when said strut is detached from said frame, said caddy may be folded to a flat, compact package.

3. A lawn bag caddy as recited in claim 2 wherein said strut is provided at the end thereof engageable with the upper leg of said frame with a longitudinally elongated loop, said loop having an opening formed in one reach thereof intermediate the ends of said loop for permitting the entry of said upper frame leg into said loop.

4. A lawn bag caddy as recited in claim 3 wherein the uninterrupted reach of said strut loop passes above said upper frame leg, whereby said loop must be engaged downwardly over said upper frame leg, and whereby a wall of a bag into which said frame is inserted will tend to hold said strut loop in engagement with said upper frame leg.

5. A lawn bag caddy as recited in claim 2 wherein said frame is formed of resilient wire and its upper leg is formed to present an upwardly extending handle loop, said stand base member being generally triangular with its apex at its extended end, whereby when said caddy is folded to a flat package, the handle loop of said frame may be elastically deformed to engage over the apex of said base member to secure said caddy in the flat package form.

6. A lawn bag caddy as recited in claim 5 wherein said side legs are disposed generally at right angles to said lower leg, and with the addition of means permitting variable adjustment of the length of said side legs, whereby when said caddy is folded to flat package form, said frame handle loop may be spaced apart from the pivotal axis of said base member at a suitable distance for engagement over the apex of said base member.

* * * * *